US010345073B2

(12) United States Patent
Colby

(10) Patent No.: US 10,345,073 B2
(45) Date of Patent: Jul. 9, 2019

(54) PNEUMATIC VALVE AND REGULATOR HAVING ROTATING COLLAR

(71) Applicant: Immortal Air, Elk Grove Village, IL (US)

(72) Inventor: Dan Colby, Elk Grove Village, IL (US)

(73) Assignee: IMMORTAL AIR, Elk Grove Village, IL (US)

( * ) Notice: Subject to any disclaimer, the term of this patent is extended or adjusted under 35 U.S.C. 154(b) by 0 days.

(21) Appl. No.: 15/373,758

(22) Filed: Dec. 9, 2016

(65) Prior Publication Data

US 2017/0211906 A1 Jul. 27, 2017

Related U.S. Application Data

(63) Continuation-in-part of application No. 13/959,824, filed on Aug. 6, 2013, now Pat. No. 9,518,800.

(60) Provisional application No. 61/680,594, filed on Aug. 7, 2012, provisional application No. 61/706,843, filed on Sep. 28, 2012.

(51) Int. Cl.

| | |
|---|---|
| ***F41B 11/723*** | (2013.01) |
| ***G05D 16/10*** | (2006.01) |
| ***F41B 11/724*** | (2013.01) |

(52) U.S. Cl.

CPC ..... *F41B 11/723* (2013.01); *F41B 11/724* (2013.01); *G05D 16/10* (2013.01); *G05D 16/103* (2013.01)

(58) Field of Classification Search

CPC ..... F41B 11/723
USPC ..... 124/73
See application file for complete search history.

(56) References Cited

U.S. PATENT DOCUMENTS

| | | | | |
|---|---|---|---|---|
| 3,559,676 | A | 2/1971 | Haskins | |
| 5,135,023 | A | 8/1992 | Ross | |
| D357,967 | S | 5/1995 | Colby | |
| 5,411,053 | A | 5/1995 | Markham et al. | |
| 5,860,447 | A | 1/1999 | Chu | |
| 6,363,964 | B1 | 4/2002 | Carroll | |
| 6,405,722 | B2 | 6/2002 | Colby | |
| 6,422,265 | B1 | 7/2002 | Beyer et al. | |
| 6,478,046 | B2 | 11/2002 | Gabrel | |
| 6,543,475 | B2 | 4/2003 | Colby | |
| 6,722,391 | B2 | 4/2004 | Gabrel | |
| 6,851,447 | B1 | 2/2005 | Carroll | |
| 7,004,192 | B2 | 2/2006 | Gabrel | |
| 7,059,343 | B2 | 6/2006 | Carroll | |
| 7,188,640 | B2 | 3/2007 | Gabrel | |
| 8,171,950 | B2 | 5/2012 | Colby et al. | |
| 8,991,378 | B2 * | 3/2015 | Newman | F41B 11/72 124/71 |
| 2013/0319390 | A1 * | 12/2013 | Newman | F41B 11/72 124/73 |

* cited by examiner

*Primary Examiner* — Reginald S Tillman, Jr.
(74) *Attorney, Agent, or Firm* — Bishop, Diehl & Lee, Ltd

(57) ABSTRACT

A pneumatic regulator assembly for a paintball marker includes a first body portion with a connector at one end for attachment to a paintball marker, a second body portion with a connector at one end for attachment to a compressed air canister, and a collar coupled between the two body portions at ends opposite the connectors for each. The collar allows the second body to rotate relative to the first body portion.

4 Claims, 9 Drawing Sheets

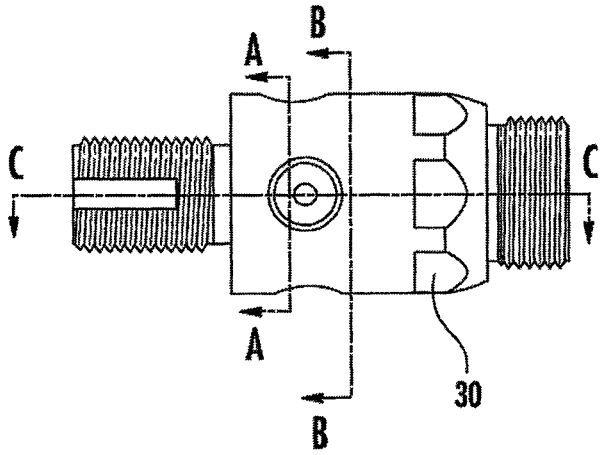
FIG. 4A
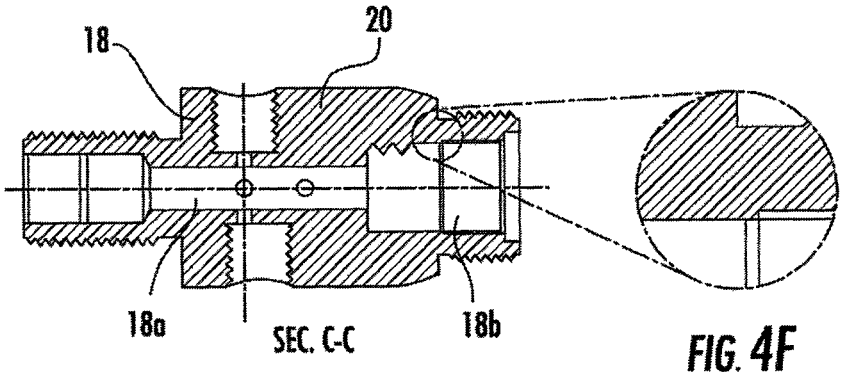
FIG. 4B
FIG. 4F
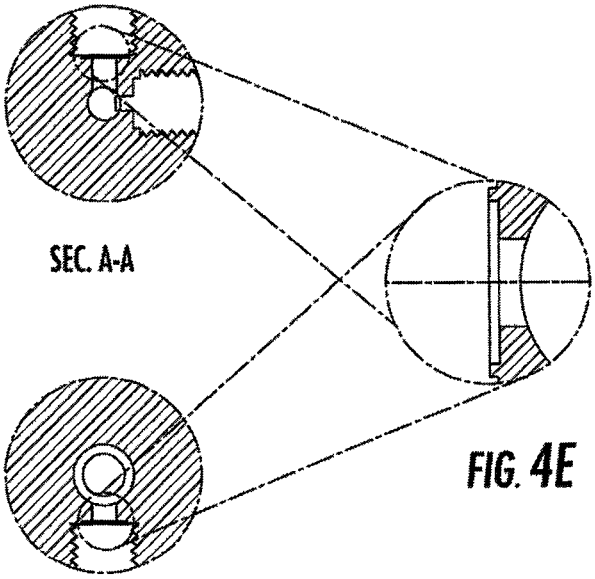
FIG. 4C
FIG. 4E
FIG. 4D

PNEUMATIC VALVE AND REGULATOR HAVING ROTATING COLLAR

RELATED APPLICATIONS

The present application is a continuation-in-part (CIP) of U.S. Pat. No. 9,518,800 A1, titled "Pneumatic Valve Regulator" and issued on Dec. 13, 2016 from U.S. application Ser. No. 13/959,824 filed on Aug. 6, 2013. The entirety of the '800 patent is hereby incorporated by reference.

TECHNICAL FIELD OF THE INVENTION

The device of this application relates to a pneumatic valve and regulator which regulates the output delivery pressure from a pressure vessel. More particularly, the device relates to a pneumatic-type regulator containing a pressure activated demand valve configured to be attached to, for example, a paintball gun or BB gun.

BACKGROUND OF THE INVENTION

Pressure regulators that deliver discrete charges of fluid are employed in a wide variety of industries for a wide variety of purposes—e.g., to activate controls, provide control, fire projectiles, provide feedstock—and uses—e.g., as a diluent, catalyst, carrier, or fuel to processes. The relevant industries share in common a need for a regulator that reliably delivers accurately metered amounts of fluid at a controlled pressure and at scheduled times or on demand. One such industry that requires such discrete charges on demand is the paintball game industry.

The popularity of paintball games has grown immensely, and with that growth there has been a proliferation of different types of paintball guns (hereafter "markers") and the devices that are used in conjunction with these markers, such as regulators and compressed gas canisters. Improvements in markers and related devices have become necessary due to the increased level of play as players improve and hone their skills. It is believed that improvements in paintball equipment encourage improvements in players' abilities and skills, which in turn requires further improvements in the equipment. The early types of markers and related devices provided an adequate level of play. However, the onset of more experienced players, along with challenging paintball gun tournaments, now provides an arena where better markers and peripherals are required to sufficiently compete.

Safety is a serious concern with any system where pressurized gas is confined or handled in the equipment. Canisters typically confine gas under several thousand pounds of pressure. Regulators that are in gas receiving communication with such canisters are sometimes exposed to the pressure that is in the canister. Regulators generally function to regulate the pressure that associated applications are exposed to. Often such associated applications are not capable of withstanding the gas pressure that is in the canisters. Unexpected spikes in gas pressure are sometimes encountered by such canisters and associated regulators. Regulators must be designed to reliably prevent excessive gas pressure from reaching the associated applications. Regulators are typically designed with sufficient strength to confine and regulate pressurized gas with a safety factor of at least twice the maximum anticipated pressure. This safety requirement dictates that the regulator be constructed with sufficient mass to provide the required strength. This can make a regulator heavier and larger than desired in many systems.

In general, a marker is used to fire or shoot a paintball at an intended target. A discrete charge (as opposed to continuous flow) of compressed gas is delivered from a canister through a regulator to a paintball marker to propel a paintball towards the intended target. The marker or paintball gun is attached directly or indirectly through a suitable conduit to a regulator, which is in turn attached to the source of compressed gas, such as a canister. The regulator meters the volume and controls the pressure of the gas charge that is delivered to the marker.

The overall marker-regulator-canister system in a paintball gun application is sometimes awkward and heavy to handle, especially for smaller game participants. Even a small reduction in size and/or weight is significant in increasing the usability and enjoyment of using the system. Also, any increase in the number of shots that may be reliably obtained from a given system without recharging the canister significantly improves the play of the user.

Many paintball guns operate on compressed gas such as air, nitrogen, other suitable gases or mixtures of gases. The players typically carry a supply of compressed gas with them as they compete. This supply is depleted after a certain number of cycles. Typically, the players have no means of replenishing this supply of compressed gas without returning to some central station removed from the playing field. Compact lightweight systems that extend the number of cycles that are available from one canister full of gas are much sought after by players.

Any regulator in a marker-regulator-canister system that safely provides a reduced size and weight advantage and extends the period of play or other use while remaining reliable and consistent would be uniquely advantageous. As such, there is a great need in the field of paintball systems and other systems for such regulators.

Further, while many experienced and top-level players own and maintain high-end markers, facilities exist which appeal to all levels of players, including the novice. Accordingly, such facilities often rent equipment, including markers and marker assemblies, to players who do not have or do not want to use their own equipment. This equipment (like most rental equipment) is subjected to an inordinate amount of wear without the requisite cleaning and care to operate effectively. The rental market posses a unique market opportunity in the industry.

Another issue with current regulators is that proper attachment to a paintball marker results in the pressure gauge facing downward. Checking canister pressure requires flipping the marker upside down, which may be down frequently during tournament play, for example. Of course, during active play this puts a player in a compromised position.

Regulators for regulating pressurized gas that is delivered from a canister to a paintball gun or a marker are illustrated in Colby U.S. Pat. No. Des. 357,967, Colby U.S. Pat. No. 6,543,475, Colby U.S. Pat. No. 6,405,722, Carroll U.S. Pat. No. 6,851,447, Carroll U.S. Pat. No. 6,363,964, Gabrel U.S. Pat. No. 7,004,192, Gabrel U.S. Pat. No. 7,188,640, Gabrel U.S. Pat. No. 6,722,391, and Gabrel U.S. Pat. No. 6,478,046, each of which is hereby incorporated by reference as if fully set forth herein.

Accordingly, there exists a need for a regulator for compressed gas that is safe, compact, light-weight, reliable, and with adjustability. There is a need for the combination of these features in one regulator.

SUMMARY OF THE INVENTION

A paintball marker assembly including an improved regulator which avoids the disadvantages of prior devices while affording additional structural and operating advantages is described. Generally, the marker assembly includes a marker, a compressed fluid source, and a regulator to safely couple the marker and fluid source.

An improved regulator is also described. Generally, the regulator includes a body having an inlet orifice for connecting to the compressed fluid source, an outlet orifice for connecting to the marker, and a cavity formed therein having a first chamber proximate the outlet orifice, a second chamber proximate the inlet orifice and providing a fluid pathway between the inlet and outlet orifices, a poppet valve functionally positioned within the outlet orifice, and a pneumatic valve actuator positioned within the cavity of the body and supportively coupled to the poppet valve.

In an embodiment, the pneumatic valve actuator comprises a first body portion with a connector at one end for attachment to a paintball marker, a second body portion with a connector at one end for attachment to a compressed air canister, and a collar coupled between the two body portions at ends opposite the connectors for each. In this embodiment the collar allows the second body to rotate relative to the first body portion.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

FIGS. 4A through 4F are engineering drawings of an embodiment of the body of the regulator of FIG. 3;

DETAILED DESCRIPTION OF THE INVENTION

Figure 1:
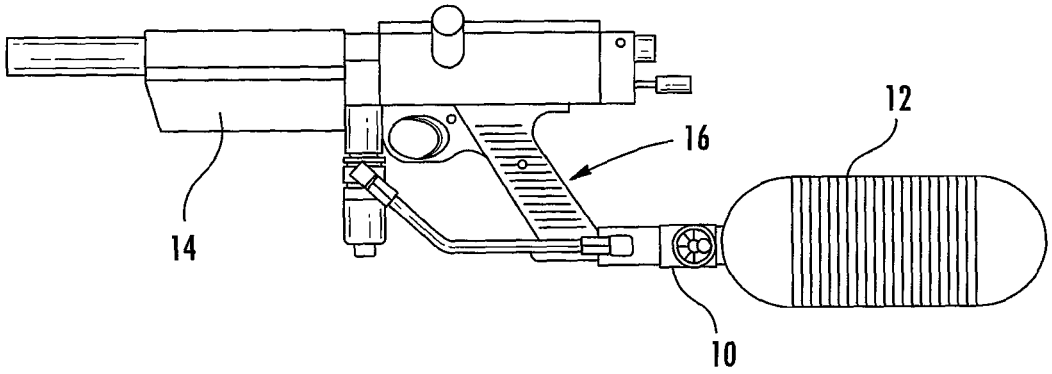
FIG. 1 is a side view of a marker assembly including a marker, regulator and pressure vessel.

While this invention is susceptible of embodiments in many different forms, there is shown in the drawings and will herein be described in detail at least one preferred embodiment of the invention with the understanding that the present disclosure is to be considered as an exemplification of the principles of the invention and is not intended to limit the broad aspect of the invention to any of the specific embodiments illustrated.

Further, there are illustrated embodiments of the disclosed regulator in conjunction with a paintball gun (aka, marker). In fact, while all the embodiments illustrated or described may specifically reference use for a paintball gun, it should be understood that the principles of the invention may be more broadly applied to other uses as well, as would be known and understood by those skilled in the art.

As used herein "canister" includes all manner of pressure vessels, including, but not limited to small portable bottles or tanks, large stationary tanks, tanks connected to compressors, metallic containers, composite plastic containers, single or plural use pressure vessels, or other sources of compressed gas, and the like.

As shown in FIG. 1, a complete paintball marker assembly includes a single stage regulator system 10 in accordance with the present invention, attached to a high-pressure vessel 12, and a marker 14. The pistol grip 16 on the marker 14 is typically where the regulator assembly 10 is connected. The regulator assembly 10 is described in more detail below.

Generally speaking, the present regulator assembly is a single stage regulator, designed to accept input working pressures up to 4,500 pounds-per-square-inch (PSI), and designed to regulate an output pressure in the range of between about 250 and about 1,150 PSI. The various embodiments of the present regulator assembly 10 are considered to be compatible with many of the Paintball guns or markers currently used in the sport of Paintball.

A preferred embodiment of the assembly 10 incorporates advantages over prior devices, including considerably reduced size and weight, resulting in material cost savings, utilizing common round stock instead of customized square stock, a smaller, more efficient profile, elimination of high points that may impede ease of screwing regulator into marker, reduced labor cost on assembly by using a simple threaded screw attachment method, and improved safety and all-around ease of use.

The regulator assembly 10 is first attached to the vessel 12 via a threaded fitting 15 at the inlet end of the regulator assembly 10, as is well-known in the art. The regulator assembly 10 is semi-permanently connected to the high-pressure bottle or vessel 12, and is not intended to be removed. When the compressed air/gas falls below the operational pressure level the pressure vessel 12 can be refilled through a port on the regulator assembly 10.

Figure 2A:
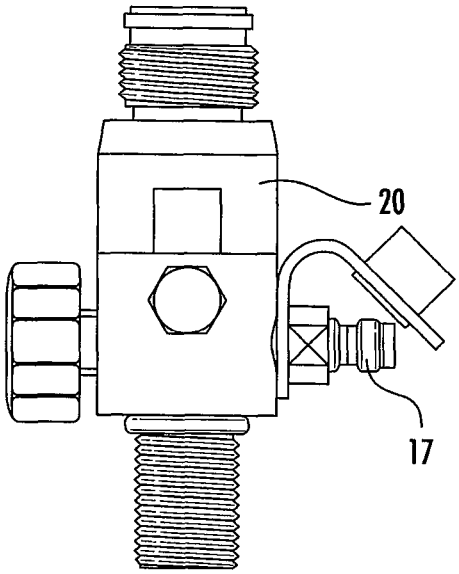
FIGS. 2A through 2C are engineering drawings of a first embodiment of a regulator in accordance with the present disclosure.
Figure 2B:
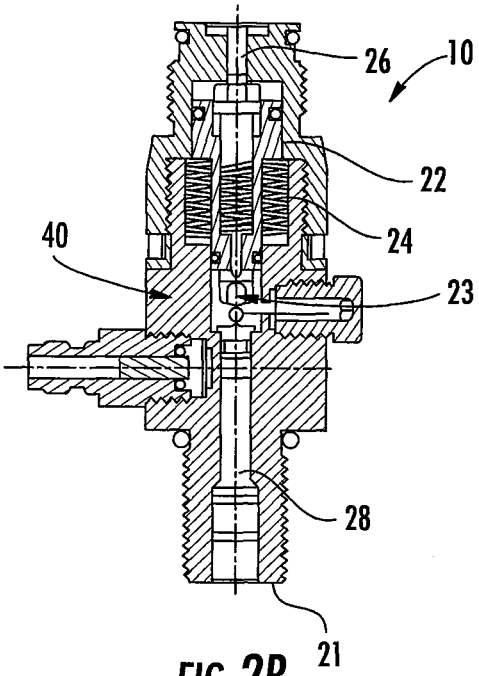
Figure 2C:
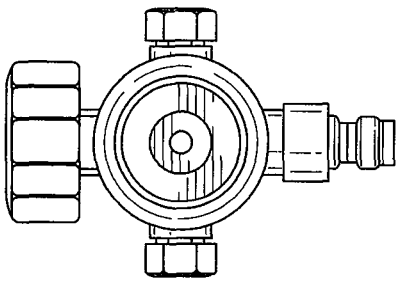

To fill the vessel 12, a form of compressed air/gas compatible with those normally used in conjunction with the sport of Paintball is used. The vessel 12 is filled through a rated fill nipple and one-way check valve 17 (FIG. 2). Once the vessel 12 is filled and ready to go, the regulator 10 is screwed into the marker 14, by screwing the male CGA portion of the regulator 10 into a female adapter (of the same thread design) either located remotely or on a marker 14. The regulator 10 and vessel 12 system will fill the marker 14 and the marker lines to a factory set preset output pressure, in the preferred embodiment, of about 250, 550, 850 and 1150PSI, though other preset values are possible.

Figure 3A:
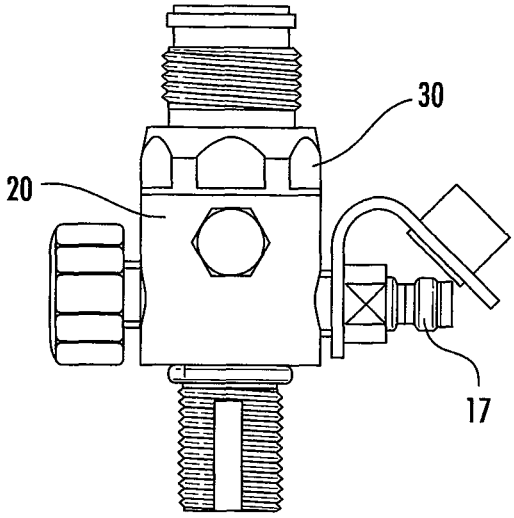
FIGS. 3A through 3C are engineering drawings of a second embodiment of a regulator in accordance with the present disclosure.
Figure 3B:
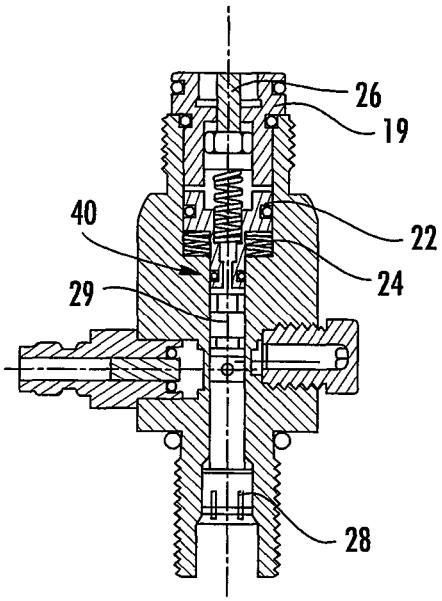
Figure 3C:
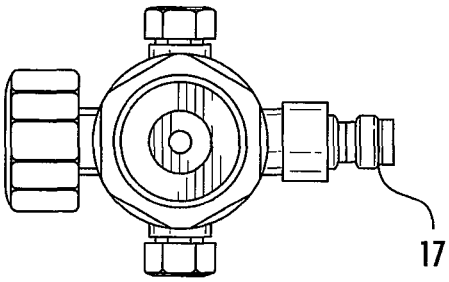
Figure 5:
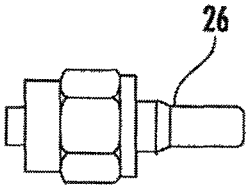
FIG. 5 is an engineering drawing of an embodiment of a poppet valve.
Figure 6:
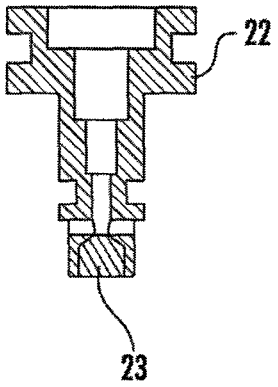
FIG. 6 is an engineering drawing of an embodiment of a piston.
Figure 7:
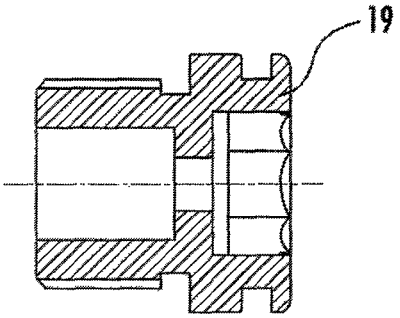
FIG. 7 is an engineering drawings of an embodiment of the gland nut used in the regulator of FIG. 3.
Figure 8:
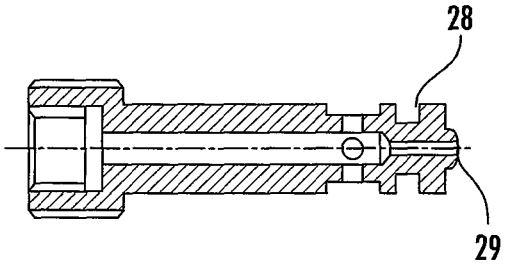
FIG. 8 is an engineering drawing of an embodiment of an adjustment shaft.

FIGS. 2A-2C and 3A-3C shows alternate embodiments of the regulator assembly 10 as a two-piece construction (FIGS. 2A-2C) and a one-piece construction (FIGS. 3A-3C). The two-piece regulator assembly (FIGS. 2A-2C) is a high-performance regulator suited for top-level players. The one-piece regulator assembly (FIGS. 3A-3C) is aimed at the rental market. By "two-piece" it is meant that the body of the regulator has two sections which are fastened together (threadably attached, as shown). Another distinction in the two embodiments illustrated is the use of a removable gland nut 19 which treadably engages the body of the one-piece configuration. The removable gland nut 19 allows the internals of the regulator to be positioned within the body 20. While this component is necessary for the one-piece configuration, it may also be used on the two-piece configuration, if desired.

Preferably the internals (described below) of the one-piece "rental market" regulator include a stainless steel adjustment shaft/strut 28 with a V-cut face nozzle and a urethane seat, which is far more tolerant of dirt and debris entering the air cavity. This rugged combination may also be used in the two-piece internals, but the brass adjustment shaft/strut with plenum and a polymeric seat (described below) is preferred. As will be more fully described below, the remaining general components and operation of the two regulators are substantially identical.

For example, each one- and two-piece regulator assembly 10 includes a body 20 having an internal cavity 18, a piston 22 biased by a spring pack 24 (an arrangement of Belleville disk springs) toward a poppet valve 26, and an adjustable shaft 28 for regulating airflow at an inlet opening.

As previously disclosed, the regulator assembly 10 may also include a high-pressure inlet fill nipple and valve 17 used for filling the pressure vessel 12. The male valve 17 attaches to the regulator 10 and can be used with a fill station containing a suitably rated female fitting. When the pressure vessel 12 falls below the operational levels, the filling station containing the female fitting is connected to the regulator assembly 10 at the high-pressure inlet male fitting, and high pressure gas, air or nitrogen is transferred from the filling station through the regulator assembly 10 and into the high-pressure bottle 12.

Both the two- and one-piece configurations have a hex-shaped body 20 which preferably includes tool flats 30 (see FIG. 3A) to allow a wrench or similar device to be used for tightening the regulator 10 to the vessel 12. The body 20 conceals an internal cavity 18 which can be divided into two chambers, an inlet side chamber 18A and an outlet side chamber 18B. The body 20 also houses the regulator internal systems, including a pneumatic valve actuator 40 positioned within the cavity 18 of the body and supportively coupled to the poppet valve 26. The pneumatic valve actuator 40 comprises the adjustable air delivery shaft 28 for regulating airflow from the fluid source (i.e., the vessel 12) through inlet orifice 21 and into the cavity 18 via a nozzle 29, the reciprocating piston 22 having a polymeric seat 23 at one end for blocking the nozzle 29, and a spring pack positioned about the piston 22 and secured thereon to bias the piston 22 to close a passage connecting the two cavity chambers, 18A and 18B.

Figure 9:
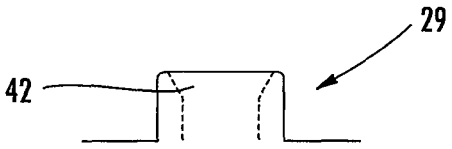
FIG. 9 is a partial cross section of an embodiment of a nozzle on an adjustment shaft showing the metering orifice.

The piston 22 is preferably configured to open and close the passage between the inlet or first chamber 18A and the outlet or second chamber 18B of the cavity 18. The piston 22 acts as an air manifold to direct air between the two chambers of the cavity 18, as is known in the art. At the inlet end of the piston a polymeric seat 23 is used to seal against the nozzle 29 of the adjustment shaft 28. The adjustment shaft 28 comprises a passageway there through which has a volume, and the nozzle 29 is fluidly coupled to the passageway. As shown in FIG. 9, the nozzle 29 is cut to create a plenum 42 which increases the volume of the passageway. This provides an increased upper end output pressure. Further, as opposed to the V-cut rim of typical stainless-steel shafts which use a softer urethane seat, a brass shaft is preferred with a polymeric seat 23 on the piston 22. The polymeric seat 23 may be comprised of any suitable polymer material, though polytetrafluoroethylene and similar polymer materials are preferred. In special situations, the TEFLON and urethane seats may be used in either.

The poppet valve 26 is seated within the body 20 as well directly coupling to the pneumatic valve actuator 40 instead of being contained in a separate compartment. This saves considerable time and cost in manufacturing over prior devices. The poppet pin engages and disengages the transfer of regulated (output) pressure, while the poppet spring ensures the return of the poppet pin to a closed position.

The Belleville disk springs of the spring pack 24 are configured such that a determined amount of spring energy can build to offset compressed gas pressure energy. A key feature of the present regulator assembly 10 is that it has a modular component. Specifically, an O-ring and washer on the piston 22 secure the Belleville disk springs in place to create a unitary component. This spring pack 24 is readily removable from the pneumatic actuator 40 and can be quickly replaced with a greater or lesser output rated spring pack, each of which is created by varying the number and/or orientation of the Belleville disk springs. The regulator assembly 10 can go from a 250PSI output up to a 1150PSI output and then back down to a 550PSI output in just a few minutes time by merely changing out the modular spring pack 24.

As described above, the regulator 10 and vessel 12 are usually combined together and not intended to be separated. When the vessel 12 is empty, filling of the pressure vessel 12 can take place through the regulator assembly 10. The compressed gas will pass through the body 20, across the ports of the adjustment shaft 28 and down into the pressure vessel 12 for storage. Once the pressure vessel 12 filled, the system is ready to go.

First, the regulator assembly 10 and vessel 12 are attached to the marker 14 by screwing the male CGA portion of the regulator 10 into a female adapter (of the same thread design) either located remotely or on a Paintball marker 14. Once attached, the vessel 12 and regulator system 10 will fill the marker 14 and the lines to a factory set preset output pressure, in the preferred embodiment about 250 to 1,150 PSI. The marker 14 is now ready for firing.

When the user pulls the trigger on the marker 14, a demand is created for the propellant gas. The gas travels from the regulator assembly 10 into the marker 14, and forces or expels the paint ball (not shown) from the marker 14.

Once the propellant exits the regulator assembly 10, the pressure therein is reduced. This reduction in pressure forces the seat 23 to unseal at the nozzle 29, thereby allowing the regulator assembly 10 to again fill and regulate an amount of propellant.

In particular, once the marker 14 is connected to the regulator assembly 10, compressed gas travels from the vessel 12 up through the adjustment shaft 28, which is set at a predetermined depth for the desired system output pressure within design parameters. The gas (and pressure) crosses the regulator seat 23 utilizes the piston 22 as an air manifold and makes contact with the top of the piston 22. As the gas flows through to the piston 22, pressure is applied to the top of the piston 22. The pressure applied to the top of the piston 22 is transferred to the spring pack 24 (i.e, the array of Belleville disk springs). The energy developed by the compressed gas is applied to the energy generated by the spring pack 24. The balance of these two forces along with the gap between the regulator seat 23 and the adjustment shaft nozzle 29 acts to regulate airflow and pressure. The flow can be increased or decreased by altering the gap between the regulator seat 23 and the adjustment strut nozzle 29 based on compressed gas/spring energy. Hence, the pressure on the backside of the poppet valve 26 is regulated. The poppet valve 26 remains in a closed position thereby sealing off the outlet or second chamber 18B and the regulated gas is prohibited from passing to ambient air.

When the regulator system 10 is screwed into a female CGA thread equipped with a depressor pin, as those found in a standard marker 14, the depressor pin will engage the exposed portion of the poppet valve 26 and depress the poppet pin against the poppet spring. Once the poppet valve 26 is forced to the open position, regulated compressed gas will begin to flow into the female adapter, creating a pressure drop.

The introduction of a pressure drop to the "low side" of the regulator 10 causes the spring pack 24 energy to overcome low side compressed gas pressure, thereby forcing the piston 22 upward. The gap between the regulator seat 23 and adjustment shaft nozzle 29 increases. As described above, an increase in gap creates additional gas flow, which applies additional force to the topside of the piston 22. The piston 22 is driven back down against spring energy and closes the gap between the adjustment strut nozzle 29 and the regulator seat 23.

While the embodiments of the present regulator assembly may have structural similarities to that of prior regulators, e.g., the pneumatic regulator illustrated in U.S. Pat. No. 6,543,475, the following is a non-exhaustive list of body design changes to the regulator assembly of the present invention which distinguish it from all other regulators in the industry, including that of the '475 patent. Specifically, the present regulator assembly 10 has:

- a smaller round body design which replaces the bulky four (4) bolt square body design;
- two sets of safety set screws which replace the use of four long-drilled and tapped 10/32×¾ bolts used to hold the two body halves together;
- wrench flats added to the bonnet design for ease of removal; and
- safety bleed grooves which have been added to the regulator stem, to allow for safe venting of the pressure canister in the event the regulator begins to separate from the canister.

Additionally, internal part changes, specifically as compared to the regulator of the '475 patent, include:

- removal of the independent brass poppet and poppet spring, and removal of the stainless steel poppet retainer secured and torqued in with Loctite® or similar material, replaced with a simple spring inserted into the back end of the piston pushing up against a brass poppet and sealing element;
- changed interior design of poppet assembly to eliminate the need for custom matching;
- changed parameters of the spring pack, using larger Belleville washer in order to increase the stability and provide better air flow;
- uses an adjustment shaft to eliminate need for fixed metering orifice and allowing for quick changing of the metering orifice to provide almost unlimited options, including more range of firing.

The changed interior design which eliminates the need for custom matching provides a significant cost savings on both production and assembly labor. Further, the options provide by the use of the adjustment shaft are a feature today's paintballers are looking for with the new electric markers. The adjustability allows the present regulator to keep up with special demands the gun/marker manufacturers are requiring of air delivery, including different out pressures needed to be competitive. This feature eliminates the need to make a different regulator each time a different application is needed.

At first use, the pressure in the canister is typically several times the output pressure of the regulator. For example, the pressure in the canister may be as much as 4,500 pounds per square inch (psi), and the designed output pressure from the regulator in paintball systems may be approximately 800 psi, more or less. For other systems the output pressure may range from as little as approximately 5-10 psi to as much as approximately 1,150 psi or more. The regulator delivers gas to the marker at a predetermined maximum pressure one discrete charge at a time. The regulator accepts pressurized gas from a canister until the pressure within the regulator reaches a predetermined value and then shuts off the flow into the regulator. In paintball games the charge of gas is held in the regulator for an indefinite period of time until the player fires the marker. That is, the charge is available instantaneously for on demand use. For some applications charges are released at previously scheduled regular or irregular intervals. Releasing the charge immediately exhausts the charge from the regulator and delivers it to the marker or other application. The regulator then seals itself from outputting gas to the marker and opens its inlet to receive another charge of gas from the canister, and the cycle of fill, hold, and discharge starts over.

Cycle rates (the maximum number of complete fill-hold-discharge cycles per second) should generally be in the range of at least 2 to 10 cycles per second. Reliable cycle rates in excess of this may be required or desired for other applications.

Turning now to the embodiment of FIGS. 10-13, regulator 110 has the added benefit of a rotating collar 190 which allows the gauge 192 and fill nipple 194 to be rotated to a more favored position for use. The regulator 110 has a two-part body, i.e., first and second body portions 120A/120B, a gauge 192, a fill nipple 194, two safeties 112/112A, and a rotatable collar 190 coupled between the two body parts (i.e., 120A and 120B). The second body portion 120B is connectable to a compressed air bottle 12 (see FIG. 1) by fixing the regulator 110 on the neck of the bottle. The gauge 192 is used by a player to determine the air remaining in the connected canister.

Figure 10:
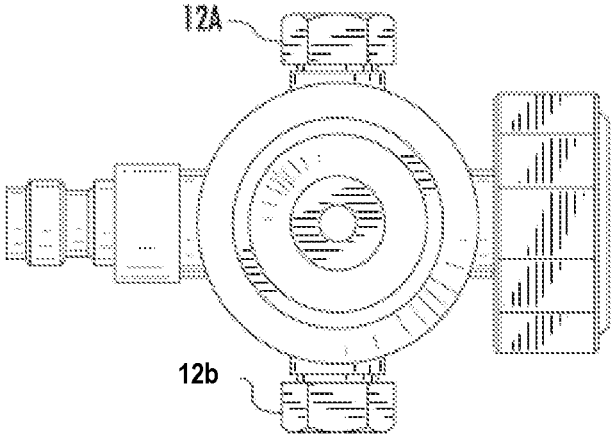
FIG. 10 is a top view of an embodiment of the disclosed regulator having a rotating collar.
Figure 11:
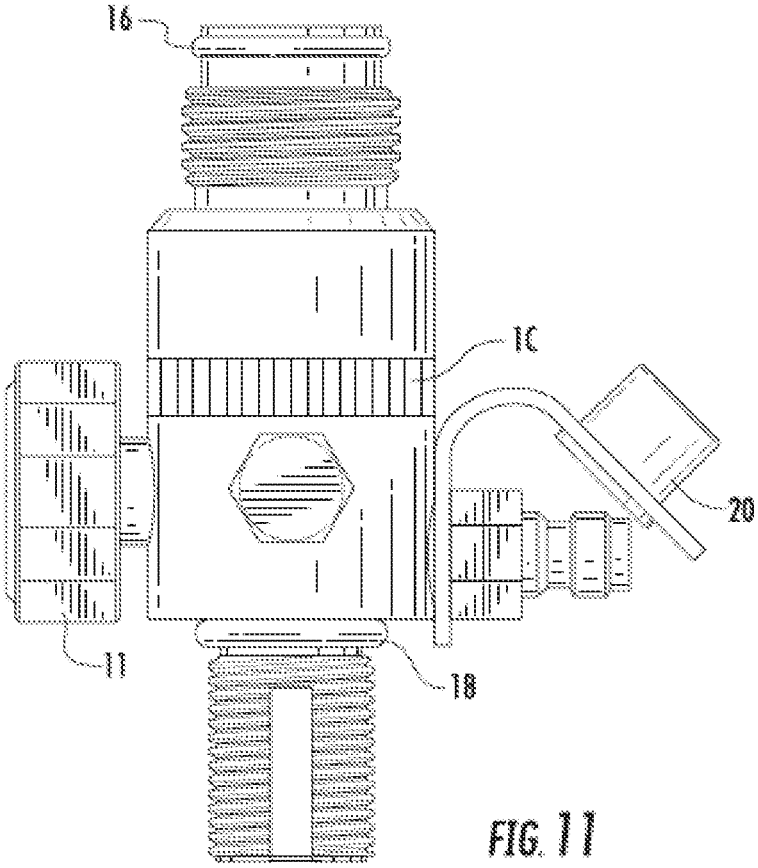
FIG. 11 is a side view of the regulator shown in FIG. 10.
Figure 12:
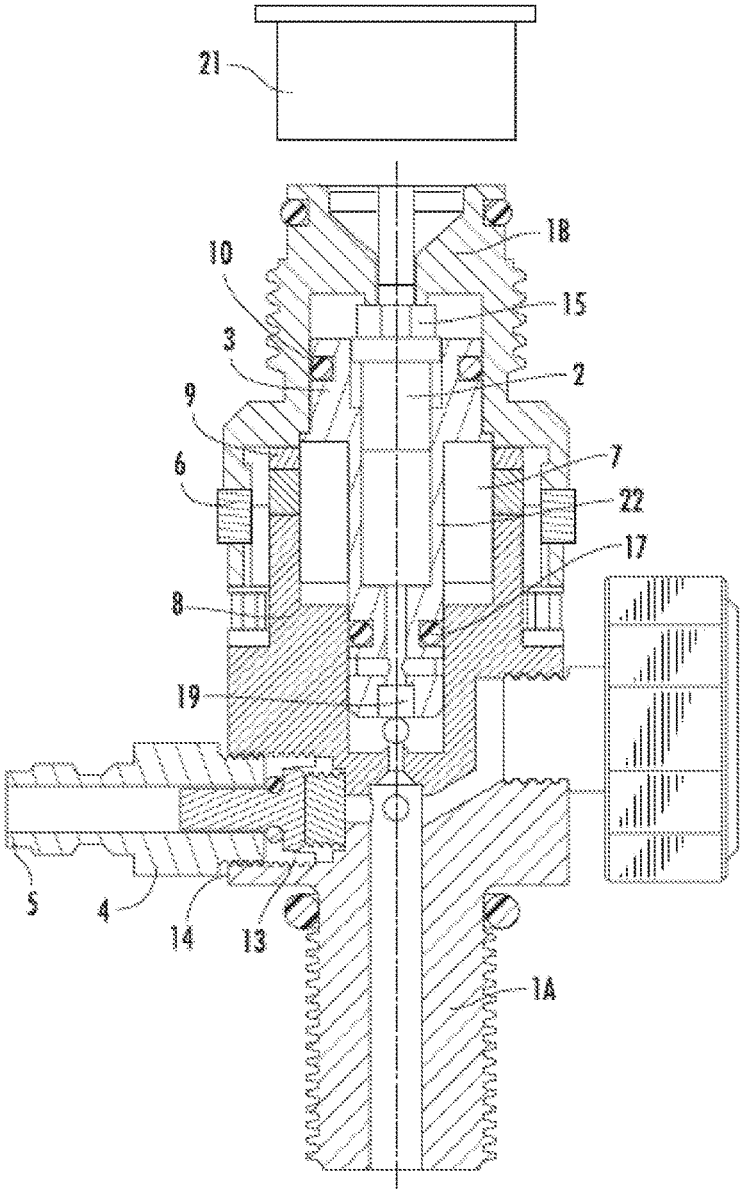
FIG. 12 is a cross section of the regulator shown in FIG. 10.
Figure 13:
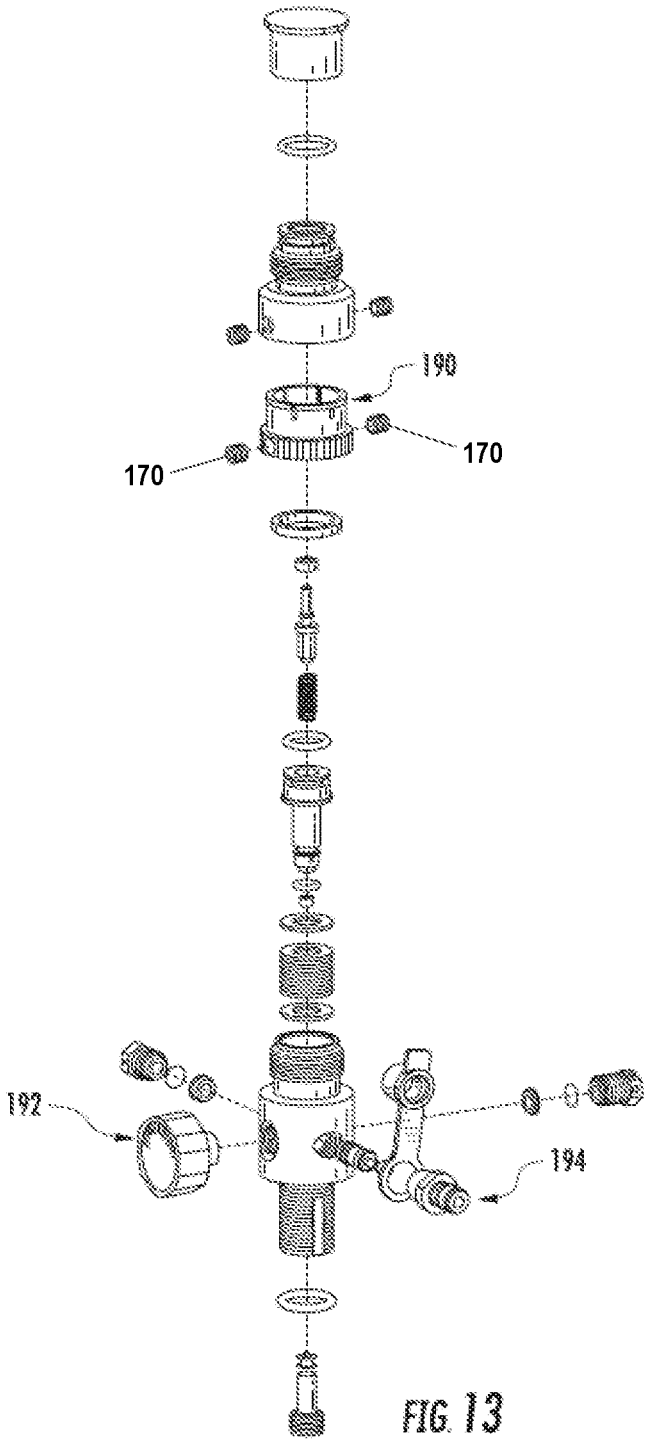
FIG. 13 is an exploded view of the embodiment of FIG. 10.

With continued reference to FIGS. 10-12, the following table provides a listing of the drawing reference number, part name, quantity and a preferred material for each listed component. This listing is limited to FIGS. 10-12.

TABLE (for FIGS. 10-12)

| Ref. No. | Description | Material | Quantity |
|---|---|---|---|
| 1A | First body | A6061 | 1 |
| 1B | Second body | A6061 | 1 |
| 1C | Swivel ring | 1214L | 1 |
| 2 | Axle leading | C3604 | 1 |
| | Piston | C3604 | 1 |
| 4 | Valve axle | C3604 | 1 |
| 5 | Adaptor | SUS303 | 1 |
| 6 | Spring | SUS304 | 1 |
| 7 | Disc spring | 1085 | 1 |
| | Screw | SCM435 | 2 |
| 9 | Screw | SCM435 | 2 |
| 10 | O-Ring | NBR | 1 |
| 11 | Gauge | C3604 | 1 |
| 12 | Safety Plug assembly | | 1 |
| 12A | Rupture disc | OFHC COPPER | 1 |
| | Cap | C1100 1/2H | 1 |
| | Safety Plug | C3604 | 1 |
| 13 | Spring | SUS304 | 1 |
| 14 | O-Ring | NBR | 1 |
| 15 | Gasket | PU | 1 |
| 16 | O-Ring | PU | 1 |
| 17 | O-Ring | NBR | 1 |
| 18 | O-Ring | NBR | 1 |
| 19 | Polymer Disc | PTFE | 1 |
| 20 | Dust Cover | TPR | 1 |
| 21 | Protect Cover | PVC | 1 |
| 22 | Fixed Ring | C3604 | 1 |

Once the regulator 110 is screwed onto the paintball marker 14, two side screws 170 forming a locking mechanism on the collar 190 can be loosened to allow the body 120B of regulator 110 to rotate 360 degrees. This design allows the regulator 110 to rotate the gauge 192 to a desired orientation, regardless of the marker that is being used. That is, each marker is typically going to have a different thread adapter, and each time the regulator 110 is screwed onto a different marker it will have a different gauge position. The disclosed embodiment alleviates that issue and allows a user to predetermine the position of the gauge before the system is pressurized.

Another advantage to the rotating collar 190 is that it allows players to adjust the position of the fill nipple 194 on the regulator 110. Some people find that the fill nipple 194 will dig into their wrists during play. The rotating collar regulator 110 will also alleviate that issue and allow the user to rotate the regulator 110 so the fill nipple 194 is at a position which does not cause any problems.

While previous embodiments focus on the use of an adjustable strut, the present embodiment can be made using either an adjustment strut or a fixed port design.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A pneumatic regulator assembly for a paintball marker, the regulator assembly comprising:

a first body portion having an external surface with a circular cross-section, an outlet orifice and a connector at one end for attachment to a paintball marker;

a second body portion rotatingly coupled to the first body portion and having an external surface with a circular cross-section, an inlet orifice and a connector at one end for attachment to a compressed air canister, wherein the first body portion and the second body portion have a cavity formed therein which provides a fluid pathway between the inlet and outlet orifices;

a collar having an internal surface with a circular cross-section and coupled between the two body portions at ends opposite the connectors for each;

wherein the collar comprises a locking mechanism which can be locked to prevent rotation of the second body portion relative to the first body portion and unlocked to allow the second body portion to rotate relative to the first body portion, wherein the external surface of the second body portion mates with the internal surface of the collar and the internal surface of the first body portion mates with the external surface of the collar; and a pneumatic valve actuator positioned within the cavity comprising; an adjustable air delivery shaft for regulating airflow from the compressed air canister through the inlet orifice and into the cavity.

2. The pneumatic regulator assembly of claim 1, wherein the second body portion comprises a gauge.

3. The pneumatic regulator assembly of claim 1, wherein the locking mechanism comprises securing screws.

4. The pneumatic regulator assembly of claim 1, wherein the adjustable air delivery shaft has a nozzle with cut plenum to increase volume of passageway.

* * * * *